US005144877A

United States Patent [19]

Parks

[11] Patent Number: 5,144,877

[45] Date of Patent: Sep. 8, 1992

[54] PHOTOREACTIVE CAMOUFLAGE

[76] Inventor: Jeffery S. Parks, 1310 Kingsley, Mt. Clemens, Mich. 48043

[21] Appl. No.: 724,076

[22] Filed: Jul. 1, 1991

[51] Int. Cl.[5] ..... F41H 3/00

[52] U.S. Cl. ..... 89/36.01; 359/241; 428/919

[58] Field of Search ..... 89/36.01; 359/241; 428/919

[56] References Cited

U.S. PATENT DOCUMENTS 3,485,764 12/1969 Kazan ..... 359/241
3,684,352 8/1972 Luboshez ..... 359/241
4,145,536 3/1979 Heller ..... 430/962
4,205,988 6/1980 Ozaki et al. ..... 359/241

*Primary Examiner*—Stephen C. Bentley
*Attorney, Agent, or Firm*—Peter A. Taucher; David L. Kuhn

[57] ABSTRACT

The invention is a camouflage system for the exterior of a military vehicle. The system includes a set of photoreactive lenses on the vehicle, the lenses having an irregular topography and a thin anti-reflection film on the faces of the lenses. The system reduces or eliminates contrast between illuminated and shadowed panels of the vehicle so that the vehicle more thoroughly blends into the background against which the vehicle is viewed.

12 Claims, 3 Drawing Sheets

PHOTOREACTIVE CAMOUFLAGE

GOVERNMENT USE

The invention described herein may be manufactured, used and licensed by or for the U.S. Government for governmental purposes without payment to me of any royalty thereon.

BACKGROUND

For decades, painting of camouflage patterns on military vehicles has been used to lower their visibility on the battlefield. One problem for these vehicles is that sun light striking one side of the vehicle tends to illuminate one side and leave the opposite side in shadow. The contrast between the illuminated side and the shadowed side tends to makes the vehicles stand out from the background against which they are viewed.

SUMMARY OF THE INVENTION

The invention is a set of photoreactive facets or lenses disposed on the outside of a military vehicle, the lenses darkening more as the intensity of the light striking them increases. The lenses will cover the painted camouflage pattern and reduce the contrast between illuminated vehicle surfaces and shadowed vehicle surfaces. The lenses I propose are very thin and will therefore add little to the space envelope occupied by the vehicle. The lenses will also contribute little to the vehicle's weight. The camouflage pattern on the vehicle can be sufficiently light in color so that the darkening effects of the photoreactive lenses and the shadows will cause the pattern to match the vehicle's background.

DETAILED DESCRIPTION

Figure 1:
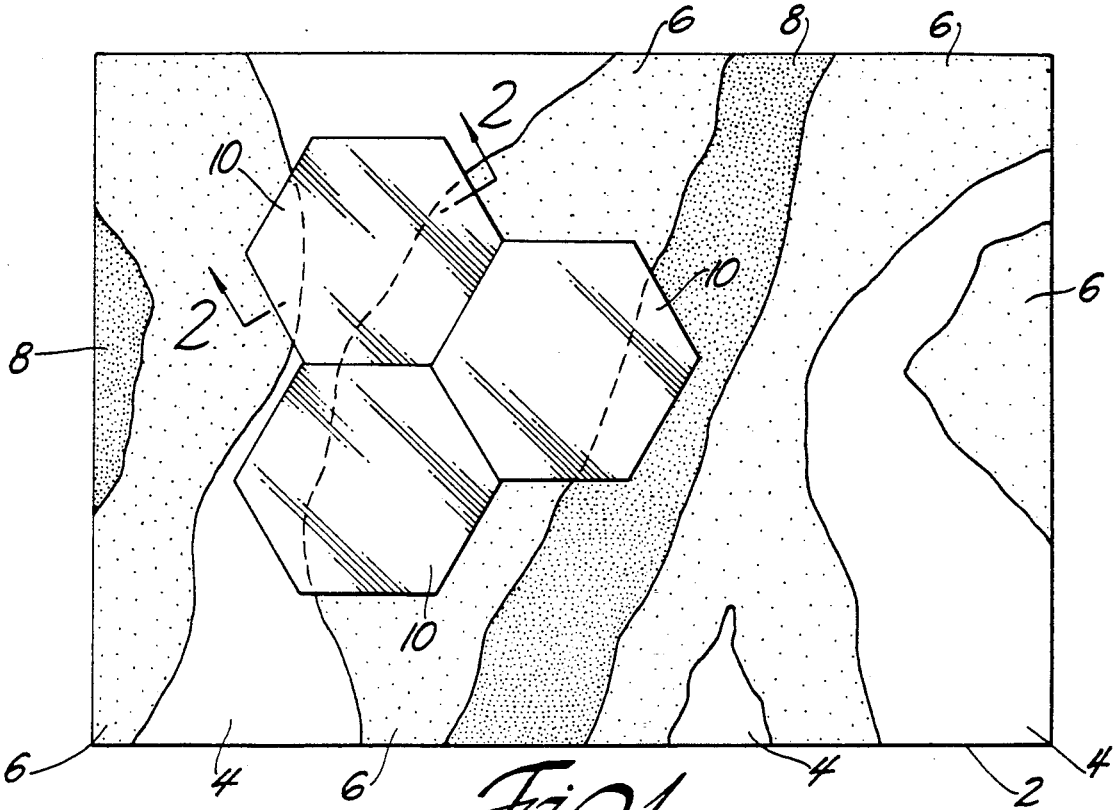
FIG. 1 is a front elevational view of an exterior plate of a military vehicle having a camouflage pattern thereon, the plate being partly covered by photoreactive lenses.

In FIG. 1 is shown a steel plate 2 having a comouflage color pattern painted on its surface, the camouflage pattern having areas of a first color 4, areas of a second color 6, and areas of a third color 8. On the surface of plate 2 are flat hexagonal lenses 10, which are made of glass, plastic or other transparent material. For purposes of illustration, only part of the plate in FIG. 1 is covered by lenses, but in practice, the entire plate will be covered. The lenses will contain photoreactive material so that they will darken when light from the visible spectrum strikes them. Individual lenses 10 can contain differing amounts of such photoreactive material so that the plates will darken to a different degree for a given intensity of visible light. The lenses can also contain differently colored photoreactive material so that visible light effects a color variation among various lenses.

The lenses are not necessarily intended to completely mask the camouflage pattern of plate 2. Rather, the lenses can selectively darken and tint the pattern to achieve a desired visual effect when light striking the plate intensifies. In the alternative, it is possible for plate 2 to have no camouflage pattern and to select the tint, photoreactivity and distribution of lenses 10 so that the lenses alone provide the camouflage pattern.

Figure 2:
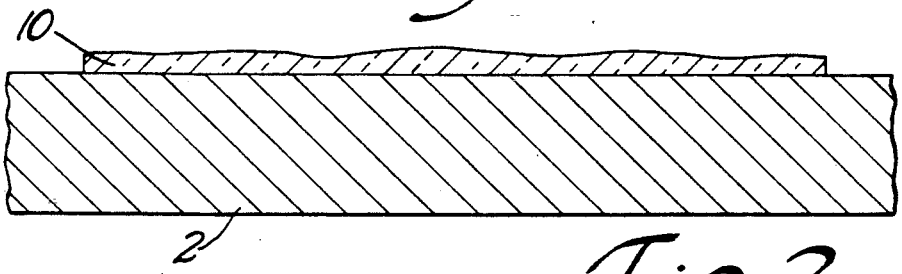
FIG. 2 is a sectional view taken along line 2—2 in FIG. 1.
Figure 3:
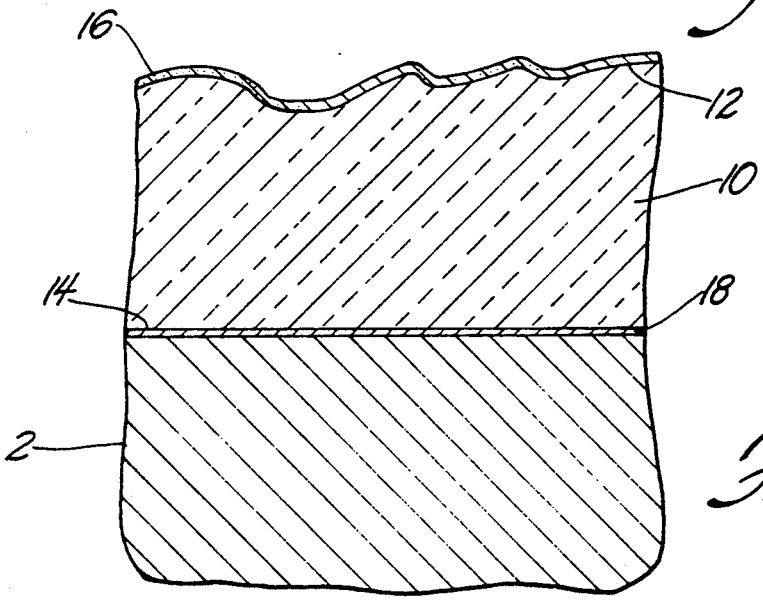
FIG. 3 is a detail of the sectional view shown in FIG. 2.

FIG. 3 is an enlargement of part of the sectional view shown in FIG. 2 and is used to show structural details of lens 10. Lens 10 has an irregular topography at surface 12 formed by randomly sized and shaped peaks or valleys so as to cause nonuniformity in the reflection or refraction of light from the surface of the lens. An antireflection film 16 such as that deposited on many camera lenses covers surface 12. The reflectiveness of lens 10 can be reduced by essentially 100%, or by a lesser degree, depending on the layer or layers comprising film 16, as is conventional.

The lenses are preferably no more than 0.0625 inches thick, their thinness minimizing the added weight and outer dimensions of vehicle on which they are installed. It is contemplated that the lenses will normally all be of the same size and will have a regular hexagonal shape, although the lenses could also be of triangular or square shape. A thin layer of adhesive 18 bonds lens 10 to plate 2, one side of layer 18 being boundary 14. The adhesive may be of an elastic composition so that part of the shock of rocks or debris striking the lens will be absorbed, whereby the lens is less likely to be cracked or shattered. Adjacent lenses need not be cemented together and may be separated by a very narrow gap so that cracks propagated in one lens will not continue into an adjacent lens.

Figure 6:
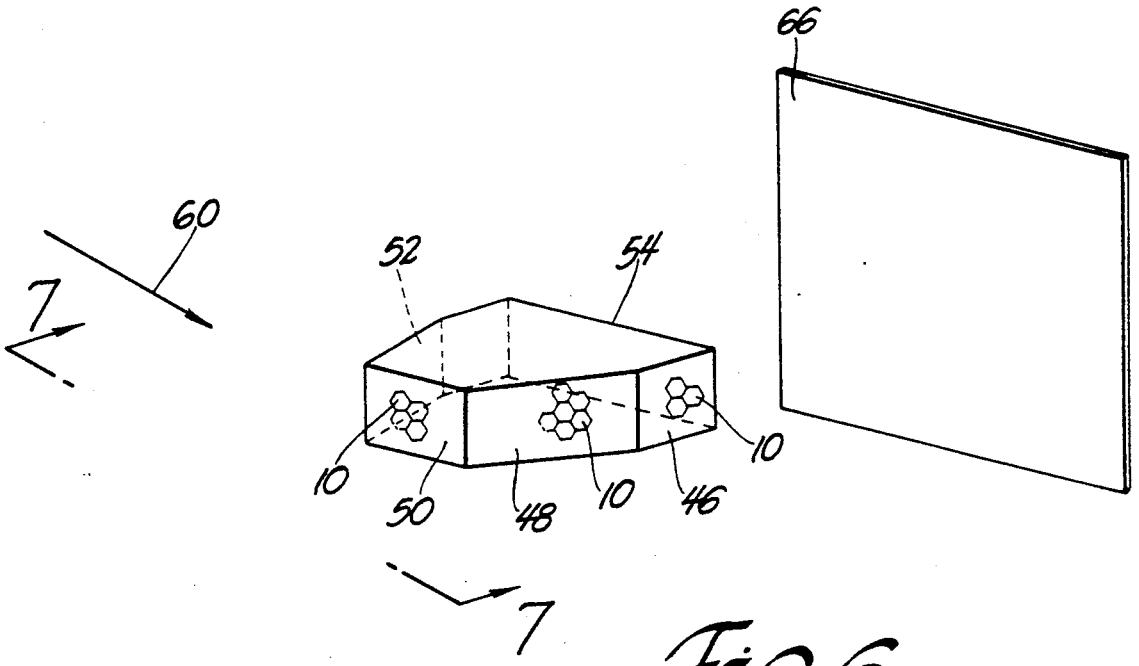
FIG. 6 is perspective view of a block disposed in front of a background screen.
Figure 7:
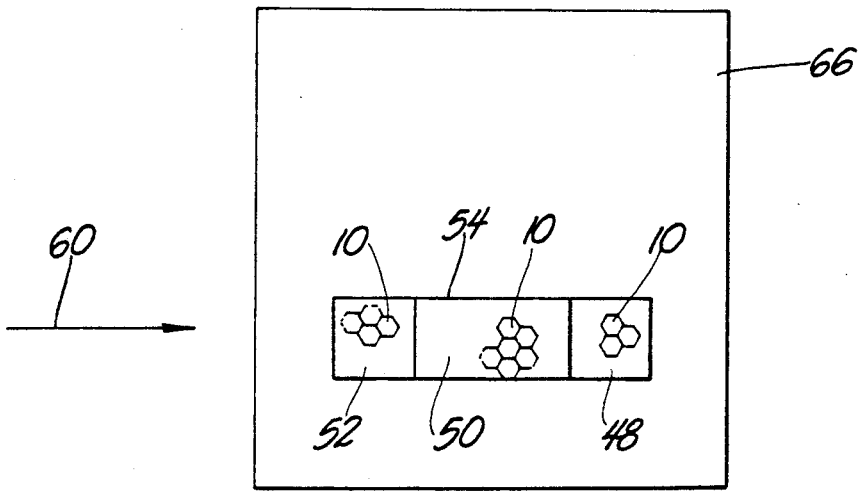
FIG. 7 is view taken along line 7—7 in FIG. 6.

FIGS. 6 and 7 will serve to illustrate how the use of facets or lenses 10 can increase the degree to which an object blends in with its background. In these figures is a screen 66, which is shown with a plain, unpatterned coloration on its surface. Screen 66 can optionally have depicted on it a representation of a typical battlefield background such as a European forest or tropical foliage. Block 54 is in front of screen 66 and has roughly the same shape as a turret of a tank. Light rays parallel to directional arrow 60 strike block 54, the light rays striking block 54 such that surface 52 is fully lit, surface 50 is partially lit and surfaces 48 and 46 are shadowed. Block 54 has a color similar to that of screen 66 but somewhat lighter in shade, and sets of lenses 10 on surfaces 46, 48, 50 and 52 will have the same average degree of photoreactivity.

When direct light strikes surface 52, photoreactive lenses 10 thereon will darken, whereby the color of surface 52 is made to match the color of screen 66. Surface 50 is partially lit, and surface 50 would appear lighter than screen 66 if it had no lenses 10. However, lenses 10 on surface 50 will partially darken so that surface 50 will have the same color shade as screen 66. It will be noted that surfaces 52 and 50 will match in color shade, the more intense lighting on surface 52 being offset by the greater darkening of the lenses thereon. No light strikes surface 48, but surface 48 will nonetheless appear to have the same color as screen 66, which is illuminated. The apparent color match occurs because the lack of illumination of surface 48 is offset by its lightness in actual color compared to screen 66. Surface 48 will also appear to have the same color shade as surfaces 50 and 52, since the greater intensity of light on surfaces 50 and 52 is offset by greater darkening of lenses on these surfaces.

The effect of the lighter coloration of block 54 as compared with screen 66 together with the effect of lenses 10 is to visually blend surfaces 48, 50 and 52 with each other and with screen 66. Consequently, block 54 is more effectively camouflaged against screen 66 than if block 54 had no lenses 10 and had the same color as screen 66. It can be seen that the camouflage technique shown in FIGS. 6 and 7 could be used in a scenario where screen 66 emulates a real background, such as a European forest. In such a case surfaces 48, 50 and 52 will have a camouflage pattern such as that of plate 2 in FIG. 1, except that areas 4, 6 and 8 will have an overall greater lightness in color than is conventional for European forest camouflage.

Figure 4:
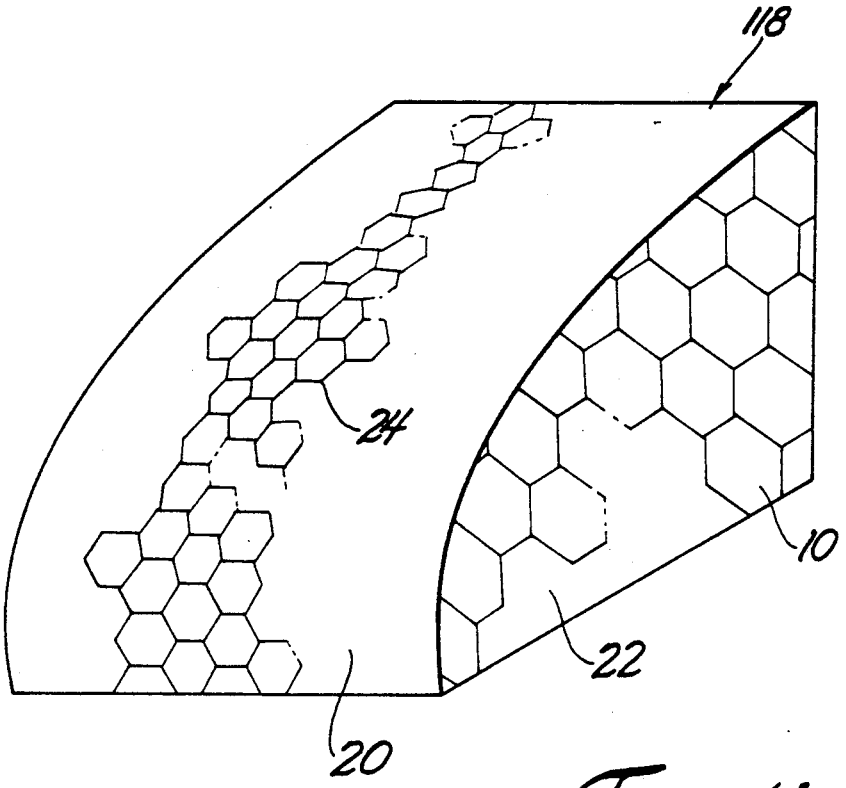
FIG. 4 is a perspective view of a block having lenses disposed on both flat and curved surfaces.
Figure 5:
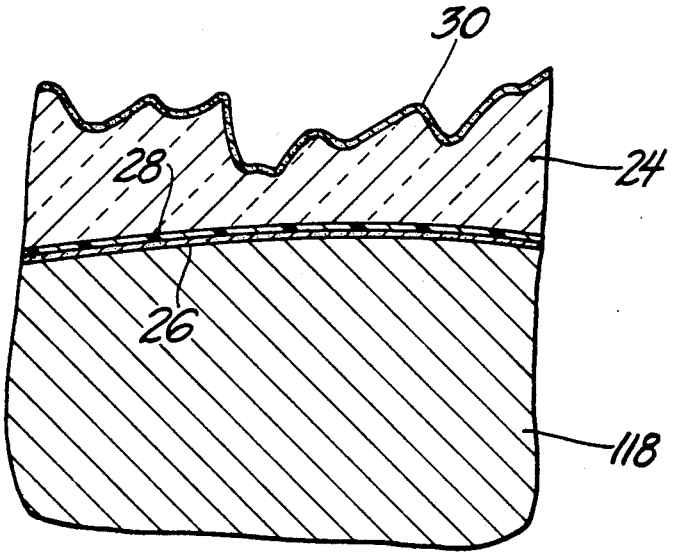
FIG. 5 is a sectional detail view of the lens on the curved surface in FIG. 4.

FIG. 4 is an arbitrarily shaped block 118 having a curved surface 20 and having a flat surface 22 covered by lenses 10. Flat surface 20 is covered by lenses 24 having a smaller width than lenses 10 but otherwise having the same design as lenses 10. Lenses 24 may be bonded to flexible substrate sheet 28, each sheet having a multiplicity of lenses 24. FIG. 5 shows a sectional detail view of lens 24 on block 118. On the upper surface of lens 24 is a thin anti-reflection film 30 similar in nature to thin film 16 in FIG. 3. An adhesive layer 26, similar to adhesive layer 14, bonds flexible substrate sheet 28 to block 118. The smaller size of lenses 24 and their and the flexibility of sheet 28 allow the lenses to be more conveniently installed on curved surfaces such as 20.

I wish it to be understood that I do not desire to be limited to the exact details of construction shown and described herein since obvious modifications will occur to those skilled in the relevant arts without departing from the spirit and scope of the following claims.

I claim:

1. A camouflage system on the exterior of a vehicle to lower the contrast between the vehicle and a background against which the vehicle is viewed, comprising:

a first surface on the exterior of the vehicle;

a second surface on the exterior of the vehicle, the second surface faced in a different direction than the first surface;

photoreactive lenses on the exterior surfaces, the average photoreactivity of lenses on on the first surface being approximately equal to the average photoreactivity of the lenses on the second surface;

an anti-reflection film on one side of the lenses;

an adhesive layer between the lenses and the surfaces.

2. The system of claim 1 wherein the one side of the lenses have an irregular topography, the topography including variously sized and shaped peaks and valleys.

3. The system of claim 2 wherein the lenses vary in color and photoreactivity.

4. The system of claim 3 wherein the lenses have generally planar shapes whose periphery forms a regular polygon.

5. The system of claim 4 wherein adjacent lenses define a narrow gap therebetween.

6. The system of claim 5 further including a flexible substrate sheet between the surfaces and the adhesive layers.

7. A camouflage system on the exterior of a vehicle to lower the contrast between the vehicle and a background against which the vehicle is viewed, comprising:

a first surface on the exterior of the vehicle;

a second surface on the exterior of the vehicle, the second surface faced in a different direction than the first surface;

a camouflage pattern on the exterior surfaces generally lighter in color than the background;

photoreactive lenses on the exterior surfaces, the average photoreactivity of lenses on on the first surface being approximately equal to the average photoreactivity of the lenses on the second surface;

an anti-reflection film on one side of the lenses;

an adhesive layer between the lenses and the surfaces.

8. The system of claim 7 wherein the one side of the lenses have a roughened, irregular topography, the topography including variously sized and shaped peaks and valleys.

9. The system of claim 8 wherein the adhesive layer is of elastomeric material.

10. The system of claim 9 wherein the lenses have generally planar shapes whose periphery forms a regular hexagon.

11. The system of claim 10 wherein adjacent lenses define a narrow gap therebetween.

12. The system of claim 11 further including a flexible substrate sheet between the surfaces and the adhesive layers.

* * * * *